US008860625B2

(12) United States Patent
Lindmark et al.

(10) Patent No.: US 8,860,625 B2
(45) Date of Patent: Oct. 14, 2014

(54) ANTENNA ASSEMBLIES HAVING TRANSMISSION LINES SUSPENDED BETWEEN GROUND PLANES WITH INTERLOCKING SPACERS

(75) Inventors: Björn Lindmark, Sollentuna (SE); Patrik Strömstedt, Täby (SE)

(73) Assignee: Laird Technologies AB, Kista (SE)

( * ) Notice: Subject to any disclaimer, the term of this patent is extended or adjusted under 35 U.S.C. 154(b) by 303 days.

(21) Appl. No.: 13/269,220

(22) Filed: Oct. 7, 2011

(65) Prior Publication Data

US 2013/0088402 A1 Apr. 11, 2013

(51) Int. Cl.

| | |
|---|---|
| ***H01Q 1/48*** | (2006.01) |
| ***H01Q 1/00*** | (2006.01) |
| ***H01Q 1/24*** | (2006.01) |
| ***H01Q 21/00*** | (2006.01) |
| ***H01Q 21/08*** | (2006.01) |

(52) U.S. Cl.

CPC ..... *H01Q 1/246* (2013.01); *H01Q 21/0081* (2013.01); *H01Q 21/08* (2013.01)

USPC ..... 343/848; 343/846; 343/906

(58) Field of Classification Search

CPC ..... H01Q 21/0081; H01P 3/084

USPC ..... 343/778, 848, 846, 878, 904, 905; 333/1, 4, 5, 238, 246, 204; 248/220.21, 248/220.22, 221.11, 222.11, 224.8; 403/207, 219, 364, 339, 340, 381

See application file for complete search history.

(56) References Cited

U.S. PATENT DOCUMENTS

| | | | | |
|---|---|---|---|---|
| 4,353,072 | A * | 10/1982 | Monser | 343/725 |
| 6,028,563 | A | 2/2000 | Higgins | |
| 6,040,802 | A * | 3/2000 | Smith et al. | 343/700 MS |
| 6,697,029 | B2 | 2/2004 | Teillet et al. | |
| 6,822,618 | B2 * | 11/2004 | Bisiules et al. | 343/803 |
| 7,026,889 | B2 | 4/2006 | Sledkov | |
| 2002/0135520 | A1 * | 9/2002 | Teillet et al. | 343/700 MS |
| 2010/0177012 | A1 | 7/2010 | Morrow | |

FOREIGN PATENT DOCUMENTS

WO WO 2011/031499 3/2011

* cited by examiner

*Primary Examiner* — Hoang V Nguyen
*Assistant Examiner* — Patrick Holecek
(74) *Attorney, Agent, or Firm* — Harness, Dickey & Pierce, P.L.C.

(57) ABSTRACT

Disclosed herein are exemplary embodiments of interlocking spacers that may be used for suspending transmission lines of a feed network between electrically-conducting ground planes of an antenna assembly. Also disclosed are exemplary embodiments of antenna assemblies including such interlocking spacers. An exemplary embodiment of an antenna assembly generally includes a feed network including one or more transmission lines, a first ground plane, and a second ground plane spaced apart from the first ground plane with a space therebetween. At least one pair of spacers is configured to be interlocked to one another when positioned on opposite sides of a substrate including the transmission lines of the feed network. The spacers are operable for suspending the transmission lines in the space between the ground planes.

18 Claims, 4 Drawing Sheets

ANTENNA ASSEMBLIES HAVING TRANSMISSION LINES SUSPENDED BETWEEN GROUND PLANES WITH INTERLOCKING SPACERS

FIELD

The present disclosure generally relates to antenna assemblies and more specifically (but not exclusively) to antenna assemblies having transmission lines suspended between ground planes with interlocking spacers.

BACKGROUND

This section provides background information related to the present disclosure which is not necessarily prior art.

Dual polarized antennas are used in various applications including, for example, base station antenna arrays for wireless communication systems. By way of example, a base station antenna array may include an array of antenna elements to which radio frequency (RF) signals are distributed through a feed network of microwave transmission lines or coaxial cables.

SUMMARY

This section provides a general summary of the disclosure, and is not a comprehensive disclosure of its full scope or all of its features.

Disclosed herein are exemplary embodiments of interlocking spacers that may be used for suspending transmission lines of a feed network between electrically-conducting ground planes of an antenna assembly. Also disclosed are exemplary embodiments of antenna assemblies including such interlocking spacers. An exemplary embodiment of an antenna assembly generally includes a feed network including one or more transmission lines, a first ground plane, and a second ground plane spaced apart from the first ground plane with a space therebetween. At least one pair of spacers is configured to be interlocked to one another when positioned on opposite sides of a substrate including the transmission lines of the feed network. The spacers are operable for suspending the transmission lines in the space between the ground planes.

In another exemplary embodiment, an antenna assembly generally includes a feed network including one or more transmission lines, a first ground plane, and a second ground plane spaced apart from the first ground plane with a space therebetween. One or more distributed phase shifters are slidable relative to the feed network within the space between the first and second ground planes.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
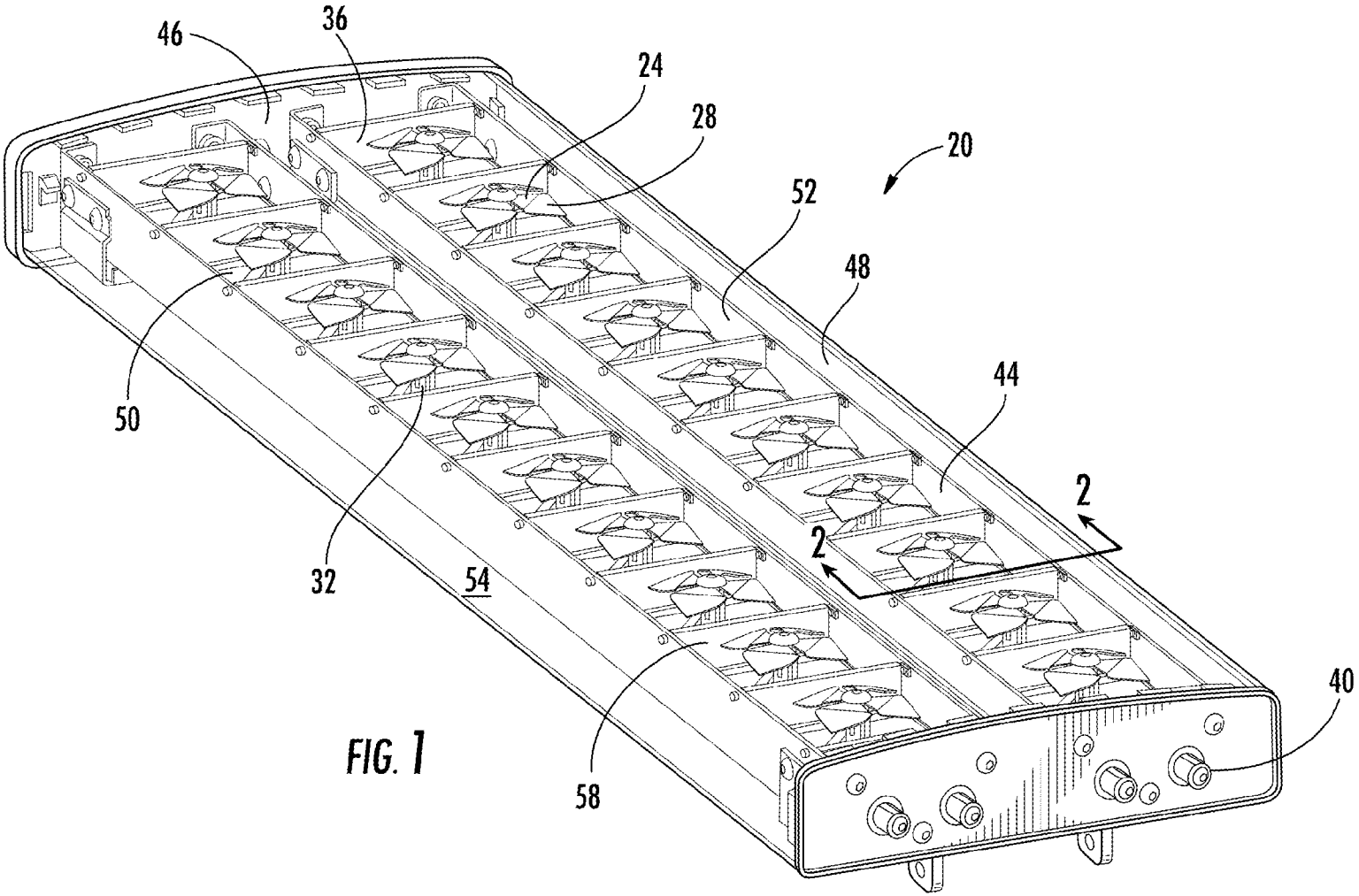
FIG. 1 is a top perspective view of an antenna assembly that includes two columns of dual polarized antennas in accordance with an exemplary embodiment of the present disclosure, wherein the antenna assembly is shown without a radome.
Figure 3A:
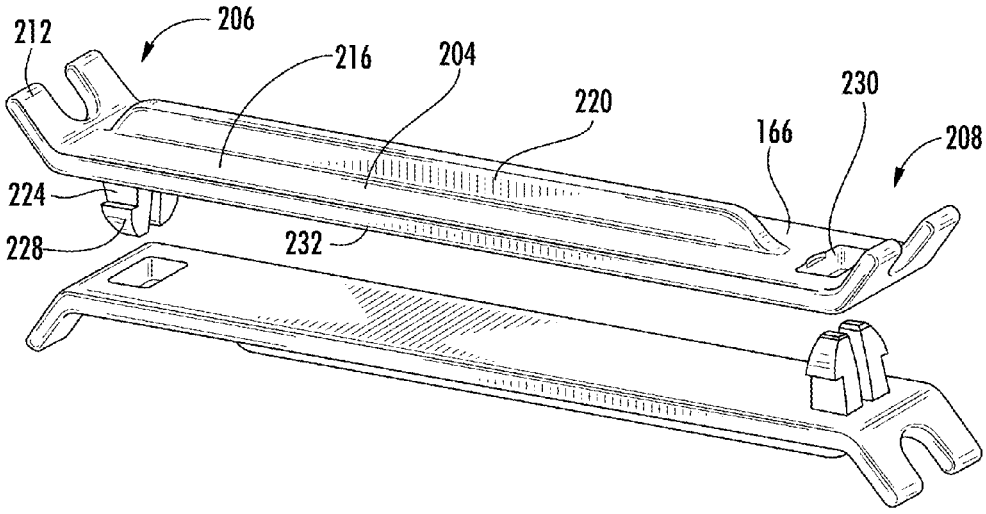
Figure 3B:
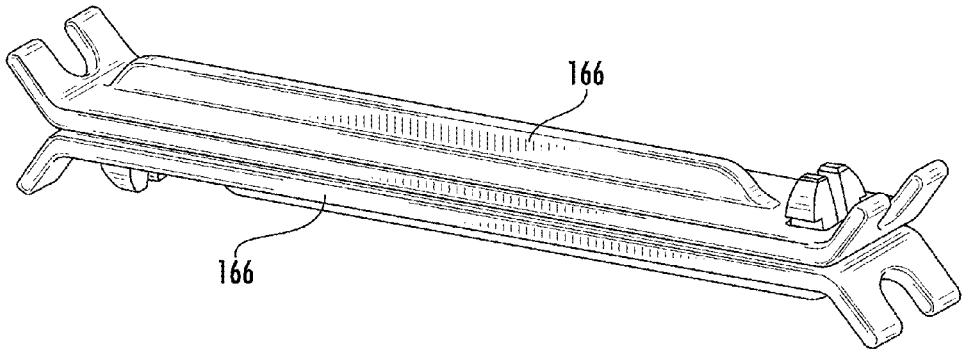
Figure 4:
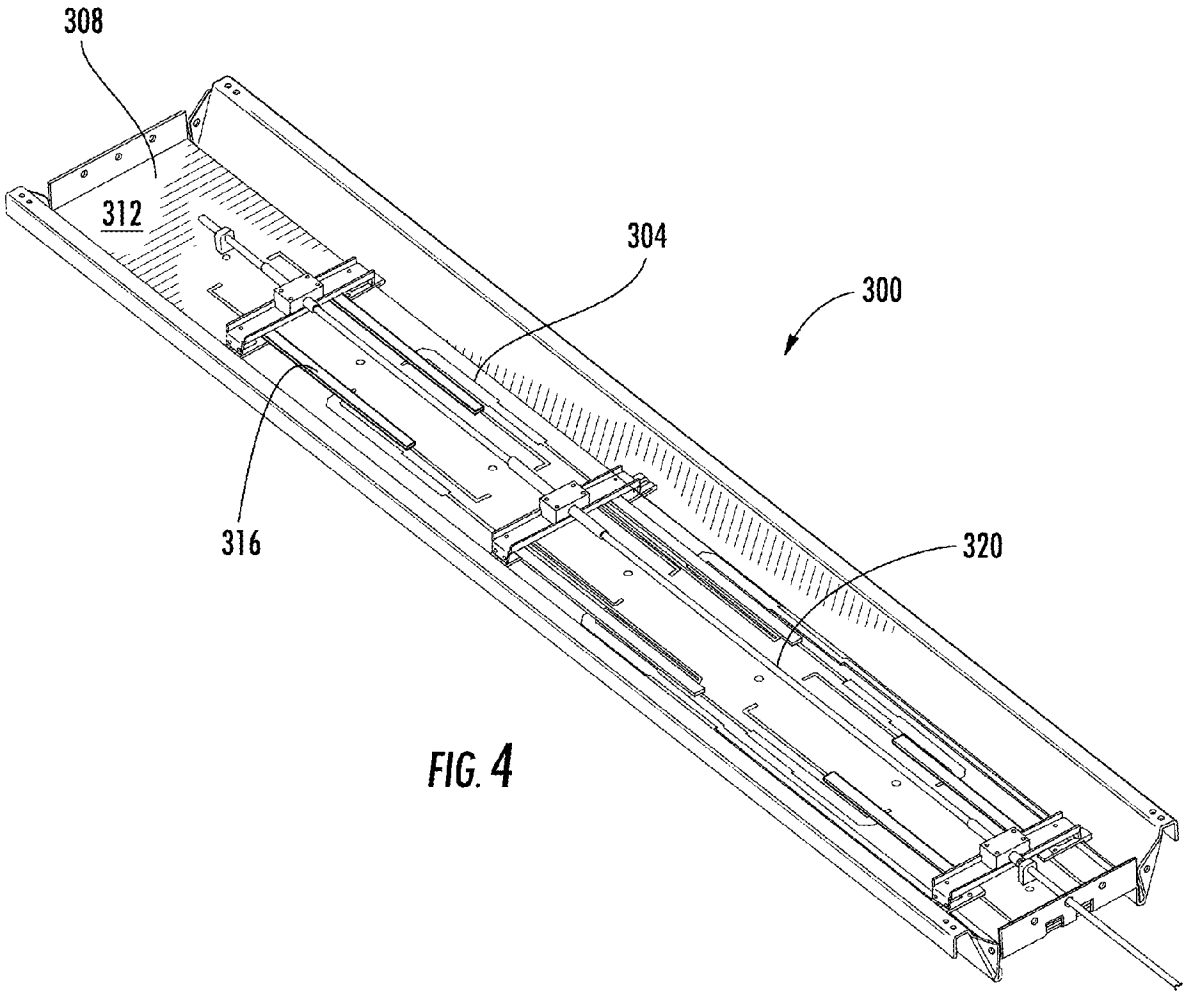

FIGS. 3A and 3B are side perspective views of a pair of interlocking spacers used in the antenna assembly shown in FIG. 1 to suspend a flex film (or other suitable material) between two electrically-conducting ground planes which flex film includes or carries transmission lines (e.g., a printed circuit, etc.) that forms a feed network in accordance with an exemplary embodiment of the present disclosure; and FIG. 4 is a top perspective view of another exemplary embodiment of an antenna assembly illustrating portions of a feed network including transmission lines (e.g., printed circuit, etc.) and distributed phase shifters that may be carried by or reside on a flex film (or other suitable material) suspended by the interlocking spacers shown in FIGS. 3A and 3B.

Corresponding reference numerals indicate corresponding parts throughout the several views of the drawings.

DETAILED DESCRIPTION

Example embodiments will now be described more fully with reference to the accompanying drawings.

Base station antenna arrays typically include linear or columnar arrays of up to ten to fifteen antenna or radiating elements, which may be distributed over a distance of about one meter to two and one-half meters. In these base station antenna arrays, a feed network of microwave transmission lines may be used to distribute radio frequency (RF) signals to these antenna elements. Traditionally, these feed networks are made from coaxial cables or microstrip lines.

As recognized by the inventors hereof, feed networks made from coaxial cables may be complex and costly. And, there may also be considerable losses depending on the coaxial cable used. Similarly, the use of a microstrip network on a printed circuit board (PCB) may also be costly and may be associated with considerable losses.

With regard to the use of a suspended microstrip, the inventors recognized that there needs to be a stable suspension of the line relative to the ground plane. Due to space and cost limitations, the feed network circuits may be around two to ten millimeters wide with a distance to the ground plane only about two to three millimeters to achieve an impedance of forty to one hundred ohms. The inventors determined that a small variation of the distance to the ground plane could change the impedance considerably, thus limiting the RF performance of the network. The inventors also realized that there may also be spurious radiation from a microstrip line when suspended in air.

Accordingly, the inventors developed and disclose herein example embodiments of interlocking spacers and feed networks in stripline form that include a flex film (or other suitable material, substrate, medium, etc.) suspended between electrically-conducting ground planes by the interlocking spacers. The flex film includes or carries transmission lines (e.g., a printed circuit, etc.) that may be used, for example, in a base station antenna array (or other antenna assembly) to distribute radio frequency (RF) signals to the antennas or radiating elements (e.g., dual polarized antennas, etc.) forming the antenna array. Exemplary embodiments of the disclosed antenna assemblies may include transmission lines operable with relative low losses and/or manufacturable at relatively low costs as compared to some other feed networks made with coaxial cables and/or microstrips on printed circuit boards.

In an example embodiment, an antenna assembly includes two columns of dual polarized antennas or radiating elements. Each polarization of each column is fed by an individual feed network with a connector at the bottom of the antenna. In this example, the antenna assembly also includes a feed network in stripline form where a thin flex film with a printed conductive circuit is suspended between two electrically-conductive ground planes, a reflector, and a feed network by interlocking dielectric (e.g., plastic, etc.) spacers. Pairs of the spacers are interlocked or fastened to each other through openings (e.g., holes, etc.) in the flex film, which thus eliminates (or at least reduces) the need to make costly holes in the reflector and feed network lid of the antenna assembly for the purpose of supporting feed network transmission lines. This exemplary manner of using the interlocking spacers to suspend the feed network transmission lines allows for reductions in manufacturing cost and complexity for many different types of antenna assemblies, particularly those for which long transmission lines are desired. In this example, transmission lines can be produced for linear arrays of antenna elements with low losses and at low cost. The interlocking spacers make it possible to provide feed networks that are less complex and less costly than networks in which coaxial cable is used.

An exemplary embodiment includes interlocking spacers that are identical or substantially identical to each other. Each spacer includes latching members or flexible, opposed prongs and an opening for engagingly receiving the latching members of another spacer, to thereby allow the two spacers to be snapped together. Each spacer includes four slanted legs such that when two spacers are interlocked to each other through holes in a flex film, the spacers' combined eight slanted legs cooperate to maintain distance to and spacing from the reflector and the feed network lid. In addition, each spacer has a raised ridge along the center line. In operation, the raised ridge may help limit the displacement of the flex film from its nominal center position between the ground planes in the event that the legs of the spacer fail to maintain sufficient pressure and spacing, e.g., due to a very high temperature or high mechanical stress due to vibration.

In an exemplary embodiment, an antenna assembly generally includes a feed network having transmission lines for coupling to and feeding one or more antennas of the antenna assembly. The antenna assembly includes ground planes separated or spaced apart by an air space or gap. Spacers are configured to suspend the transmission lines in the air space between the ground planes. The spacers are positionable on opposite sides of the substrate, member, or medium (e.g., flex film, dielectric layer, etc.) that includes or is carrying the feed network transmission lines. The spacers are interlocked or fastened (e.g., snapped, etc.) to another spacer through openings (e.g., holes, etc.) in the substrate. In some exemplary embodiments, the antenna assembly may also include a reflector and a lid for the feed network. The reflector may include one of the ground planes, while the lid for the feed network includes another one of the ground planes. In this example, the spacers are configured to substantially maintain the air space, distance, and spacing between the substrate carrying the feed network transmission lines and the ground planes, without penetrating or passing through openings in the reflector or the lid of the feed network. Additionally, or alternatively, the spacers may be interlocked or fastened (e.g., snapped, etc.) to another spacer through openings in the substrate carrying the feed network transmission lines without penetrating or passing through the ground planes. Accordingly, there are also disclosed herein methods for suspending feed network transmission lines between two grounds planes and for substantially maintaining the air space, distance, and spacing between the substrate carrying the feed network transmission lines and the ground planes, without penetrating or passing through openings in the reflector, the lid of the feed network, or the ground planes.

With reference now to the figures, FIG. 1 illustrates an example embodiment of an antenna assembly or system 20 embodying one or more aspects of the present disclosure. The antenna assembly 20 is shown without any radome to better illustrate the dual polarized antennas 24 which would be otherwise covered by the radome.

As shown in FIG. 1, the antenna assembly 20 includes a two by ten array of dual polarized antennas 24. Each antenna 24 is illustrated as being identical, but this is not required. Alternative embodiments may include more or less than two columns, more or less than ten antennas per column, unequal numbers of antennas in the columns, and/or antennas that are not identical but are dissimilar from other antennas of the antenna array.

Figure 2:
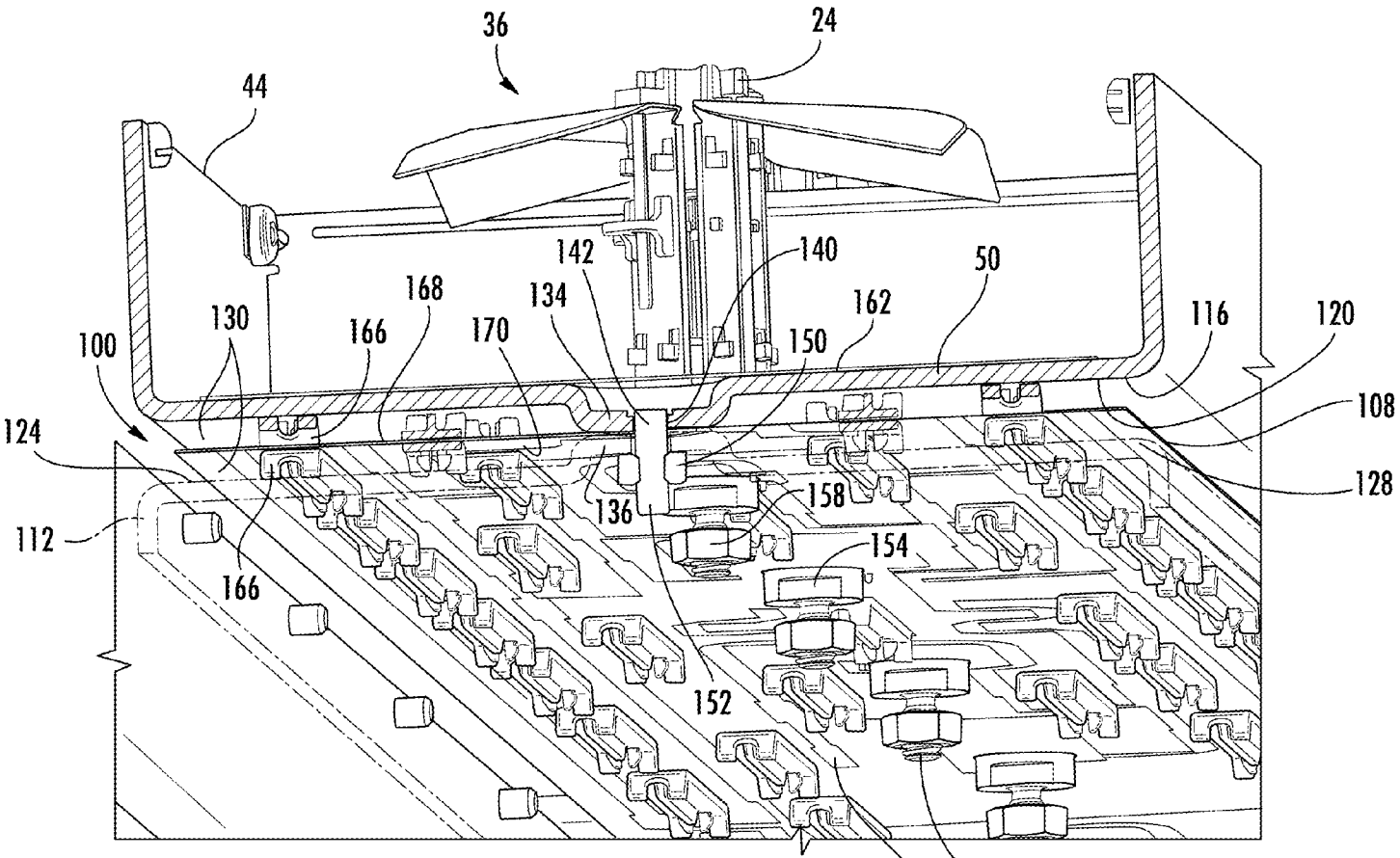
FIG. 2 is a perspective cross-sectional side view of an antenna column of the antenna assembly shown in FIG. 1 taken along the line 2-2.

With reference to FIGS. 1 and 2, an individual one of the dual polarized antennas 24 of the antenna assembly 20 will be described, with it understood that such description is also applicable to common features of each of the other antennas 24. The antenna 24 includes a plurality of antenna members 28 mounted to a carrier 32. By way of example, one or more of the dual polarized antennas 24 may be similar or identical to a crossed dipole antenna or radiating element disclosed in co-pending, commonly assigned U.S. patent application Ser. No. 12/893,093 filed Sep. 29, 2010, the entire disclosure of which is incorporated herein by reference.

As shown in FIG. 1, the assembly 20 includes two linear or columnar arrays 36. Each linear or columnar array 36 includes a plurality of antenna elements (e.g., ten antennas 24). Each columnar array 36 has a corresponding feed network (not shown in FIG. 1) that provides power and feeds the polarizations of the columnar array 36 of antennas 24. The feed networks are connected to an external power source through four ports or connectors 40. Each columnar array 36 includes a reflector 44 mounted to ends 46 of a base structure 48. Each reflector 44 has a bottom wall 50 and side walls 52. The base structure 48 has a bottom shelf 54 over which the reflectors 44 are suspended. As shall be discussed below, the feed networks are mounted below the reflectors 44. The antennas 24 of each columnar array 36 are mounted to the bottom walls 50 of the reflector 44. In each columnar array 36, a baffle wall 58 is disposed between each corresponding pair of immediately adjacent or side-by-side antennas 24. Baffle walls 58 are also disposed between the ends 46 of the base structure 48 and each end antenna 24 of the columnar arrays 36. The baffle walls 58 are attached to side walls 52 of the reflectors 44.

Although the antennas 24 are described herein as dual polarized antennas, various aspects of the present disclosure may be practiced in relation to any suitable antenna topology including, for example, single dipole antennas, cross dipole antennas, patch antennas, multi-band antennas, single polarized antennas, printed circuit boards (PCBs) including e.g., rigid PCBs, flexible PCBs, flex-film PCBs, etc. Various antenna distributions are contemplated. For example, aspects of the disclosure may be practiced in relation to base antenna arrays that may include linear arrays having up to about fifteen antennas, which may be distributed over a distance of about between one and two and one-half meters. Non-linear arrangements of antennas also are possible. An antenna assembly may have any suitable number and arrangement of antennas, with various numbers and arrangements of baffle walls. Implementations also are possible in which no baffle walls are provided.

An antenna assembly may include more or fewer than twenty antennas 24. For example, an antenna assembly may have a single antenna 24. An antenna 24 may be used for any suitable purpose. For example, an antenna 24 may be used in a WiMAX base station antenna assembly operating, e.g., in the frequency range of 2300 Megahertz (MHz) to 2700 MHz. Alternatively, or additionally, antennas 24 may be used as single band or dual band radiating elements for wireless communication systems.

FIG. 2 illustrates a feed network 100 of the antenna assembly 20. As shown, the feed network 100 includes microwave transmission lines 104 provided below the reflector 44 and connected with the antennas 24. In this illustrated embodiment, the feed network 100 is a stripline feed network including microstrip lines. Alternative embodiments may include other or additional types and/or geometries of feed networks.

The transmission lines 104 are carried by a substrate, substrate, member, or medium (e.g., flex film, dielectric layer, etc.). In this example embodiment, the substrate carrying the transmission lines 104 is a flex film 108. The strip transmission lines 104 distribute, transfer, and/or receive RF signals to and/or from the antennas 24. The strip transmission line 104 may be any suitable strip transmission line carried by any suitable network medium. For example, the strip transmission line 104 may include (without limitation) one or more electrically-conductive traces on a substrate, member, or medium, such as a rigid circuit board and/or a flexible circuit board. In one example, the transmission line 104 may be copper etched on a 125-micrometer thick polyester film.

FIG. 2 also shows a lid 112 (in phantom) that is provided for the feed network 100. When a columnar array 36 is in place in the base structure 48, the lid 112 is positioned on or over the bottom shelf 54 of the base structure 48.

In this example, two generally opposed ground planes are provided for the feed network 100. Specifically, and for example, a lower surface 116 of the reflector 44 provides a first ground plane 120. An upper surface 124 of the feed network lid 112 provides a second ground plane 128 which is spaced apart and separated from the first ground plane 1120 by a spaced distance, air space, or gap. As further described below, the flex film 108 carrying the transmission lines 104 is suspended in the air space 130 by interlocking spacers 166 on opposite sides 168, 170 of the flex film 108 and between the ground planes 120 and 128. In other embodiments, the ground planes 120, 128 may be other surfaces, discrete ground planes, etc. In various embodiments, more or less than two ground planes may be provided in an antenna assembly.

With continued reference to FIG. 2, the reflector bottom wall 150 includes one or more depressed portions 134 that correspond to one or more elevated portions 136 in the feed network lid 112. In this particular embodiment, the depressed portion 134 is not a reoccurring feature, but instead is a single feature intended for galvanic ground connection of the feed lines. When the corresponding portions 134 and 136 are connected, the air space 130 is provided between the reflector 44 and lid 112. A depressed portion 134 and corresponding elevated portion 136 are connected by a connecting post 142 extending through an opening 140 in the flex film 108. Alternative embodiments may be configured without any depressed portion 134 in the reflector bottom wall 150 and/or without any elevated portion 136 in the feed network lid 112. Further embodiments may be configured with multiple depressed portions 134 in the reflector bottom wall 150 and multiple elevated portions 136 in the feed network lid 112.

A connecting post 142 may be electrically conductive and may galvanically connect the first and second ground planes 120, 128 to each other. The connecting post 142 may be, e.g., a screw driven through corresponding openings in the reflector 44, flex film 108, and lid 112. A nut 158 or other suitable fastening element may be attached to an end 152 of the connecting post 142 to secure the connection. One or more electrically-conductive connecting posts 142 may be provided, e.g., near the connectors 40 (shown in FIG. 1) to allow galvanic contact between the strip transmission lines 104 and the first and second ground planes 120, 128. Such contact in base station antennas may operate or act as a high pass filter in the case of lightning striking the antenna installation.

Other or additional connecting or grounding posts may be installed at other or additional suitable locations. Additionally, or alternatively, one or more non-conductive or dielectric connecting posts may be provided to mechanically join the reflector 44 and lid 112, e.g., where suitable galvanic grounding is provided by other structures.

The antennas 24 may be mechanically connected to the reflector 44 using grounding posts 154. The ground posts 154 may help reduce or eliminate any potential difference between the ground planes 120 and 128. Reducing or eliminating such a potential difference may, in turn, reduce or eliminate parallel plate modes propagating in the area of the transmission lines and thereby may reduce or eliminate spurious radiation. In some embodiments, a grounding post 154 is used to mechanically connect an antenna 24 to the reflector 44. A grounding post 154 may have an upper portion (not shown) extending into the antenna carrier 32 through an opening in the reflector 44. A nut 158 may engage a threaded lower portion 160 extending through the flex film 108 and feed network lid 112.

An antenna 24 may also include feed probes (not shown) constructed of a suitable conductive material including, for example, copper, brass, nickel silver, etc. Feed probes may couple signals between the antenna members 28 and strip transmission lines 104. In various embodiments, feed probes may be connected to strip transmission lines 104 by any suitable connection (e.g. soldering, welding, adhesive glue, mating connectors, contact pins, etc.)

An antenna grounding post 154 may establish a galvanic connection between the first ground plane 120 and the second ground plane 128 near a location where a strip transmission line 104 connects to the antenna's feed probes. This may reduce or eliminate any potential difference between the first and second ground planes 120 and 128. Reducing or eliminating such a potential difference may in turn reduce or eliminate parallel plate modes propagating in the area of a strip transmission line 104 and thereby may reduce or eliminate spurious radiation.

An insulator or dielectric member 162 may be provided on the reflector 44, e.g., where the antenna 24 is capacitively coupled to the first ground plane 120. The insulator 162 may be any suitable insulator or dielectric material including, for example, insulating tape, plastic, etc. Alternatively, an antenna 24 may be galvanically connected to the reflector 44. For example, the antenna 24 may be positioned in direct contact with the reflector 44 without any insulator or space between the base portions of the antenna 24 and the reflector 44.

As shown in FIG. 2, the antennas 24 are positioned centered above their corresponding antenna grounding posts 154. In other embodiments, however, antennas may not be centered above a grounding post. For example, a patch antenna (e.g., a probe-fed patch, an aperture-fed patch, etc.) may be mechanically attached to the reflector 44 off-center from a grounding post 154. In such manner, the ground planes 120 and 128 may be connected at a location near the antenna's feed probes or aperture. It should be noted generally that antennas and feed networks could be structured, assembled into arrays or other configurations, and provided with power and suitable grounding in many different ways in accordance with various implementations of the disclosure.

FIG. 2 also illustrates the spacers 166 that are used to suspend the transmission lines 104 in the air space 130 between the ground planes 120 and 128. The spacers 166 are positioned on opposite sides 168 and 170 of the flex film 108. In the present example, the spacers 166 are fastened to one another, e.g., as pairs of spacers 166 interlocked through holes in the flex film 108. The spacers 166 support the flex film 108 in the air space 130 between the ground planes 120, 128 without penetrating the reflector 44, lid 112, or ground planes 120, 128 provided by the reflector 44 and lid 112, respectively. The spacers 166 are non-conductive or dielectric, although in some configurations one or more conductive spacers may be used.

FIGS. 3A and 3B illustrate an exemplary embodiment of a pair of spacers 166, which may be used in the antenna assembly 20 to suspend the transmission lines 104 between the ground planes 120, 128. Each spacer 166 is configured to interlock with an identical or substantially identical spacer 166 through holes in the flex film 108 (or other substrate, member, medium, etc. carrying the transmission lines). The spacers 166 may be made of plastic, e.g., injection molded as a single piece, although in other embodiments a spacer may be made of assembled parts and/or may include other or additional materials. By way of further examples, the spacers 166 may be made from a variety of plastic materials, such as plastic materials suitable for injection molding (e.g., polycarbonate (PC) plastic, acrylonitrile butadiene styrene (ABS) plastic, acrylonitrile styrene acrylate (ASA) plastic, etc.

In the illustrated embodiment of FIGS. 3A and 3B, each spacer 166 is illustrated as being identical to the other spacer 166, but this is not required. Each spacer 166 includes an elongate body 204 having first and second end portions 206, 208. Each spacer 166 includes a plurality of, e.g., four, legs 212 extending outwardly from the end portions 206, 208. The legs 212 are slanted or flared outwardly at an angle of inclination (e.g., a 135-degree angle relative to the first side 216 of the spacer body 204, etc.). A central raised ridge 220 extends longitudinally along the first side 216 of the spacer 166.

The spacer 166 also includes latching member or protrusion 224 extending outwardly from the second side 232 of the spacer 166. The latching member or protrusion 224 includes two resiliently flexible opposing prongs or latches 228 that extend outwardly from the second side 232 of the spacer 166 adjacent to the first end portion 206 (e.g., closer to the first end portion 206 than it is to the second end portion 208, etc.). An opening is between the prongs or latches 228 to accommodate movement of the prongs 228 inwardly towards one another. The spacer 166 also includes opening 230 adjacent to the second end portion 208.

The latching members 224 and openings 230 allow a pair of the spacers 166 to be "snapped" together to fasten or interlock the pair of spacers 166 to each other via holes in the flex film 108. Specifically, and for example, the prongs 228 of each spacer 166 are pressed toward each other and inserted through a corresponding hole in the flex film 108 and through the corresponding opening 230 in the other spacer 166. Upon release after being inserted through the opening 230 in other spacer 166, the prongs 228 spring apart to interlock the two spacers 166 to each other through the flex film 108.

The legs 212 are slanted and sized so as to substantially maintain the air space 130 and respective distances between the flex film 108 and reflector 44 and between the flex film 108 and feed network lid 112. The spacer legs 212 may also be pressed against and frictionally engage with the ground planes 120 and 128. If pressure is reduced between the legs 212 and the ground planes 120, 128 (e.g., due to high temperature and/or mechanical stress), the raised ridges 220 of the spacers 166 may limit displacement of the flex film 108, e.g., from a nominal center position relative to the ground planes 120, 128. Depending on the particular application, the spacers 166 may be provided in various sizes and/or positioned in various orientations relative to the flex film 108 (or other substrate carrying the transmission lines 104).

Placement of the spacers' latching members 224 and openings 230 may vary in other spacer pair configurations, so long as the latching member 224 of one spacer 166 corresponds to the opening 230 of the other spacer 166 of the pair. Other or additional spacer body shapes are also contemplated. For example, a spacer might be useful that includes at least some other or additional curvature in the body 204 and/or legs 212. As another example, a spacer may include legs 212 at other spacer locations besides or in addition to being adjacent to the spacer end portions 206, 208. Additionally, or alternatively, a spacer could have multiple extensions in place of or in addition to a single longitudinally extending raised ridge 220. Such extensions could have other or additional orientations relative to a spacer body.

Although the two spacers 166 of a pair are shown as identical in the present example configuration, one or more spacers provided on one side of a network medium could be different in various respects from one or more spacers provided on the opposite side of that network medium. For example, spacers 166 might have different leg heights, leg shapes, body shapes, ridges and/or leg inclinations to accommodate different conditions on opposite sides 168, 170 of the flex film 108. The amount of flexibility that the spacers 166 have might also vary.

FIG. 4 illustrates another exemplary embodiment of an antenna assembly in which the spacers 166 may be used. As shown in FIG. 4, the antenna assembly includes a feed network 300 and a feed network lid 308, which may provide a ground plane 312 beneath the transmission lines 304 of the feed network 300. The transmission lines 304 (e.g., printed circuit or other transmission lines) are suspended in an air space using spacers (e.g., spacers 166, etc.). For clarification, the spacers and the substrate, member, or medium (e.g., flex film or other suitable material) on which the transmission lines 304 are printed are not shown in FIG. 4.

The antenna assembly shown in FIG. 4 also includes slidable phase shifters 316 made of a suitable dielectric material. The slidable dielectric pieces that form the distributed phase shifters 316 are positioned above and below the ground plane 312. In this example, slidable phase shifters 316 are between the feed network lid 308 and the substrate carrying the transmission lines 304. Slidable phase shifters 316 are also between the substrate carrying the transmission lines 304 and, e.g., a reflector ground plane (not shown) as previously discussed in relation to FIGS. 1 and 2. In some embodiments, however, phase shifters 316 may be provided on only one side of a substrate, member, or medium carrying the transmission lines 304. To obtain a desired phase shift, an adjustment device 320 may be used to slide the phase shifters 316 lengthwise on either or both sides of the substrate carrying the transmission lines 304.

By way example, the phase shifters 316 may be made from a variety of dielectric materials. The choice of dielectric material for the phase shifters 316 may depend on selecting a material having a suitable dielectric constant. The choice of dielectric material may also depend on the manufacturing process by which the phase shifters 316 will be made, such as materials suitable for injection molding or machining of the slidable dielectric phase shifters 316. In an exemplary embodiment, the phase shifters 316 have a dielectric constant of three and are made from ULTEM 2210 Polyetherimide. Alternative embodiments may include dielectric phase shifters 316 made from other suitable materials.

As just noted, the slidable phase shifters 316 may be used in an antenna assembly (e.g., antenna assembly 20 FIGS. 1 and 2) that also includes the spacers 166 (FIGS. 3A and 3B). But in other embodiments, the slidable phase shifters 316 may be used in an antenna assembly which does not include any such spacers 166. In such embodiments, the antenna assembly may include a feed network including one or more transmission lines. A first ground plane may be spaced apart from a second ground plane with a space therebetween. One or more distributed phase shifters 316 may be slidable relative to the feed network within the space between the first and second ground planes. The antenna assembly may also include an adjustment device, which may be used to slide the phase shifters 316 relatively along (e.g., lengthwise on either or both sides, etc.) of the substrate carrying the transmission lines 304 to obtain a desired phase shift.

Numerical dimensions and values are provided herein for illustrative purposes only. The particular dimensions and values provided are not intended to limit the scope of the present disclosure.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "above" versus "directly above," "below" versus "directly below," "between" versus "directly between," "adjacent" versus "directly adjacent," etc.) As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of a device in use or operation in addition to the orientation depicted in the figures. For example, if a device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

The disclosure herein of particular values and particular ranges of values for given parameters are not exclusive of other values and ranges of values that may be useful in one or more of the examples disclosed herein. Moreover, it is envisioned that any two particular values for a specific parameter stated herein may define the endpoints of a range of values that may be suitable for the given parameter. The disclosure of a first value and a second value for a given parameter can be interpreted as disclosing that any value between the first and second values could also be employed for the given parameter. Similarly, it is envisioned that disclosure of two or more ranges of values for a parameter (whether such ranges are nested, overlapping or distinct) subsume all possible combination of ranges for the value that might be claimed using endpoints of the disclosed ranges.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. An antenna assembly comprising:

a feed network including one or more transmission lines;

an array of antennas coupled to the feed network;

a first ground plane;

a second ground plane spaced apart from the first ground plane with a space therebetween; and at least one pair of spacers positioned on opposite sides of and penetrating a substrate that includes the transmission lines and interlocked to one another through one or more openings in the substrate, the at least one pair of spacers structured to suspend the transmission lines of the feed network within the space between the first and second ground planes and to maintain a distance separating the substrate from the first ground plane and from the second ground plane, wherein one of the at least one pair of spacers is disposed between the substrate and the first ground plane, but does not pass through any opening in the first ground plane and the other one of the at least one pair of spacers is disposed between the substrate and the second ground plane, but does not pass through any opening in the second ground plane.

2. The antenna assembly of claim 1, wherein the antenna assembly includes the substrate having one or more openings through which the spacers are interlocked to one another.

3. The antenna assembly of claim 2, wherein the spacers do not pass through any openings in the first and second ground planes.

4. The antenna assembly of claim 1, wherein each spacer of the pair of the spacers comprises a latching member configured to extend through an opening in the substrate and at least partially into a corresponding opening in the other spacer of the pair of spacers, to thereby interlock the pair of spacers to one another.

5. The antenna assembly of claim 4, wherein each spacer of the pair of the spacers comprises:

a first side having one or more legs extending outwardly from the first side; and a second side including the latching member extending outwardly therefrom;

whereby the legs are operable for maintaining separation of the substrate from the first and second ground plane.

6. The antenna assembly of claim 4, wherein the latching member of each spacer includes two resiliently flexible opposing prongs configured to be movable inwardly toward one another to pass through the openings in the substrate and other spacer and to move outwardly away from each other to thereby interlock the pair of spacers to one another.

7. The antenna assembly of claim 4, wherein each spacer of the pair of the spacers comprises a raised ridge extending longitudinally along a first side, whereby the raised ridge is operable to help limit displacement of the substrate and maintain positioning of the substrate between the ground planes.

8. The antenna assembly of claim 1, further comprising:

a reflector including the first ground plane; and a lid for the feed network that includes the second ground plane.

9. The antenna assembly of claim 1, wherein the antenna assembly includes an array of dual polarized antennas coupled to the feed network, whereby the feed network is operable for feeding the dual polarized antennas.

10. The antenna assembly of claim 9, wherein:

the feed network comprises a plurality of strip transmission lines positioned between the first and second ground planes; and the antenna assembly includes at least two columns of dual polarized antennas, each coupled to at least one of the plurality of strip transmission lines.

11. The antenna assembly of claim 1, wherein the space between the first and second ground planes is filled with air.

12. The antenna assembly of claim 1, wherein the antenna assembly includes the substrate comprising one or more of a flex film and a circuit board.

13. The antenna assembly of claim 1, wherein the pair of spacers comprise a pair of substantially identical spacers.

14. The antenna assembly of claim 1, wherein each spacer of the pair of the spacers comprises a latching member configured to extend through a corresponding one of the openings in the substrate and at least partially into a corresponding opening in the other spacer of the pair of spacers, to thereby interlock the pair of spacers to one another.

15. The antenna assembly of claim 1, further comprising one or more distributed phase shifters slidable relative to the feed network within the space between the first and second ground planes.

16. The antenna assembly of claim 15, further comprising an adjustment device for sliding the distributed phase shifters relative to the substrate to thereby obtain a desired phase shift.

17. An antenna assembly comprising:

a feed network including one or more transmission lines;

an array of antennas coupled to the feed network;

a reflector including a first ground plane;

a lid for the feed network and including a second ground plane spaced apart from the first ground plane with a space therebetween; and a subtrate that includes the one or more transmission lines and one or more openings;

at least one pair of spacers positioned on opposite sides of and penetrating the substrate, the pair of spacers interlocked to one another through the one or more openings of the substrate such that the transmission lines of the feed network are suspended within the space between the first and second ground planes;

wherein:

each spacer of the pair of the spacers comprises a latching member configured to extend through a corresponding one of the one or more openings in the substrate and at least partially into a corresponding opening in the other spacer of the pair of spacers, to thereby interlock the pair of spacers to one another; and the spacers are configured to maintain a distance separating the substrate from the first ground plane and from the second ground plane when the spacers are interlocked to one another; and the latching member of each spacer includes two resiliently flexible opposing prongs configured to be movable inwardly toward one another to pass through the openings in the substrate and other spacer and to move outwardly away from each other to thereby interlock the pair of spacers to one another; and the spacers do not pass through any openings in the reflector, lid, or first and second ground planes.

18. The antenna assembly of claim 17, further comprising distributed phase shifters slidable relative to the feed network within the space between the first and second ground planes.

* * * * *